United States Patent [19]

Dannatt

[11] 4,253,007

[45] Feb. 24, 1981

[54] HOT ROLL FUSING DEVICE

[75] Inventor: Hugh St. L. Dannatt, Bethel, Conn.

[73] Assignee: Pitney Bowes Inc., Stamford, Conn.

[21] Appl. No.: 41,026

[22] Filed: May 21, 1979

[51] Int. Cl.[3] ..... H05B 3/10

[52] U.S. Cl. ..... 219/216; 219/470; 219/505; 338/22 SD

[58] Field of Search ..... 355/3 R, 3 FU, 14 FU; 219/216, 469, 470, 471, 504, 505; 338/22 R, 22 SD; 432/60, 228

[56] References Cited

U.S. PATENT DOCUMENTS

| | | | |
|---|---|---|---|
| 3,356,831 | 12/1967 | Andrus et al. | 355/3 FU X |
| 3,401,439 | 9/1968 | Staats et al. | 219/469 X |
| 3,632,971 | 1/1972 | Flanagan | 219/242 X |
| 3,645,785 | 2/1972 | Hentzschel | 338/22 SD X |
| 4,127,764 | 11/1978 | Minden | 219/216 |

*Primary Examiner*—Fred L. Braun

*Attorney, Agent, or Firm*—Melvin J. Scolnick; William D. Soltow, Jr.; Albert W. Scribner

[57] ABSTRACT

A heated fuser roll for use in a fusing apparatus for fixing toner images to a support surface. The fuser roll includes one or more heating units each of which include (i) a wafer shaped heating element formed of a semiconducting ceramic material having a positive temperature coefficient of resistivity and exhibiting a Curie temperature transition point at which the resistance of the material increases with increasing temperature and (ii) an electrically conductive member for providing electrical current to the heating elements, the conductive member being in contiguous relation to the heating element; a thermally conductive plate; and a sleeve positioned around the heating unit and the plate. An insulating member is positioned between each of the electrically conductive members and the thermally conductive plates.

17 Claims, 4 Drawing Figures

HOT ROLL FUSING DEVICE

BACKGROUND OF THE DISCLOSURE

I. Field of the Invention

This invention relates to a heated fuser device as is commonly used in xerographic copying machines, and more particularly to a heated fuser roll whose heating elements are disposed within the roll as wafer-type elements and are formed of a material that enables the fuser to be temperature-self regulating.

II. Description of the Prior Art

In a typical xerographic process a photoconductor comprising a photoconductive composition coated on a rigid or flexible substrate is uniformly electrostatically charged in the dark, and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is cleaned and the photoconductor is reused as described above for subsequent copies. The toner image that was transferred to the plain paper is then fixed thereto. Since the developing material is heat fusible, application of sufficient heat to the paper causes the developing material to melt and be fused into the paper so as to be permanently affixed thereto.

One very basic approach to fusing in a xerograhic copying machine is the use of the so-called hot roll pressure fuser apparatus. Typically, in this apparatus, the paper with the toner image thereon is passed between a pair of opposed rollers, at least one of which is heated. Generally, the heated roll is formed of a hollow cylinder having a radiant heater, such as an infrared lamp or a halogen lamp, centrally located within the cylinder to heat the roll, in series with a bimetal thermostat. A typical example of this type of heated fuser roll is illustrated in U.S. Pat. No. 3,637,976. During operation of the fusing apparatus, the paper to which the toner images are electrostatically adhered is passed through the nip formed between the rolls with the toner image contacting the fuser roll to effect heating of the toner image within the nip. Fusing is enhanced by the second roll or pressure roll as it is commonly called as the result of a biasing force which forces the rolls into engagement. The thermostat intermittently interrupts the current flow as the roll temperature reaches a predetermined value. The roll then cools to some lower temperature whereupon the thermostat restores the current, and the roll heats up again.

Many of the problems that occur with the use of a hot roll-pressure fusing apparatus are in the heated fusing roll. In particular, these problems relate to the means employed for heating the fuser roll and its control. For example, in many of the known hot-roll fusers it is extremely difficult to maintain a constant temperature at the nip of the rollers where the actual fusing of the toner occurs, and where temperature control is critical. Temperature control is difficult because (1) it is difficult to sense the temperature in this region: (2) thermal lag, i.e., the responsiveness of roll temperature under varying demands of thermal output; and (3) there are both different machine modes, i.e., standby, off, continuous operation, and different size papers to contend with. The type of thermostat control as described above is conspicuously oscillatory in nature. The thermostat, by necessity being situated on the circumference of the roll in order to control the temperature of that surface, is relatively remote from the heater and, thus, the temperature fluctuations are usually significant. Reductions in this aforesaid differential temperature characteristic requires extensive and expensive proportional feedback control means. In addition to these problems, radiant-type heated fuser rolls generally require very high heating temperatures for the heating element to enable the roll temperature in the nip of the rollers to be high enough to melt the toner. The use of these high temperatures can result in deterioration of the fuser roll.

Examples of other miscellaneous type heated rolls exhibiting many of the problems as outlined above are illustrated in U.S. Pat. Nos. 3,471,683, 3,720,808 and 4,100,397.

SUMMARY OF THE INVENTION

It is therefore an object of the present invention to overcome many of the disadvantages of the hot roll fusers described in the prior art and to provide a hot roll fuser that is temperature-self regulating and will permit relatively simple control of the temperature of the roll in the critical area where fusing occurs.

It is a further object of this invention to provide a hot roll fuser which will provide a relatively even temperature gradient along its surfaces, avoid large temperature fluctuations, and eliminate center to edge temperature differentials.

It is a further object of the invention to avoid the use of high temperature heating elements for heating a fuser roll thereby avoiding deterioration of the fuser roll.

The foregoing objects and others are accomplished in accordance with the present invention by providing a heated fuser roll for use in a fusing apparatus for fixing toner images to a support surface, the fuser roll comprising one or more heating units each of which includes (i) a wafer shaped heating element formed of a semiconducting ceramic material having a positive temperature coefficient of resistivity and exhibiting a Curie temperature transition point at which the resistance of the material increases with increasing temperature and (ii) an electrically conductive member for providing electrical current to the heating element, the member being in contiguous relation to the heating element; a thermally conductive plate; and a sleeve positioned around the heating unit and the plate.

The present invention relates to the application of ceramic heating elements of a class known as positive temperature coefficient materials (PTC) which are disposed within the roll as wafer-type elements, and which form the core of the roll. The preferred ceramic material is described as ferroelectric and has the property of possessing low resistance up to some characteristic temperature. Upon attaining this temperature, the electrical resistance of the ceramic material increases typically from 50 ohms to 5000 ohms or more within a span of less than ten (10) degrees centrigrade. It is thus to be appreciated that such a material may be configured to furnish its own thermostat, and furthermore since the effect is internal, pronounced and confined to a narrow temperature band, the oscillatory variations of temperature may be minimized. Such a system has advantages over the conventional and known methods of control. A heated fuser roll having the structure as herein described leads to superior control, the elimination of a conventional thermostat and therefore a more economical device. This also leads to a more reliable device since thermostats are somewhat prone to contact failure. The elimination of a conventional thermostat also eliminates possible electrical interference effects. The self-limiting feature of the heating elements used in the roll eliminates temperature overshoot and promotes rapid heat up.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
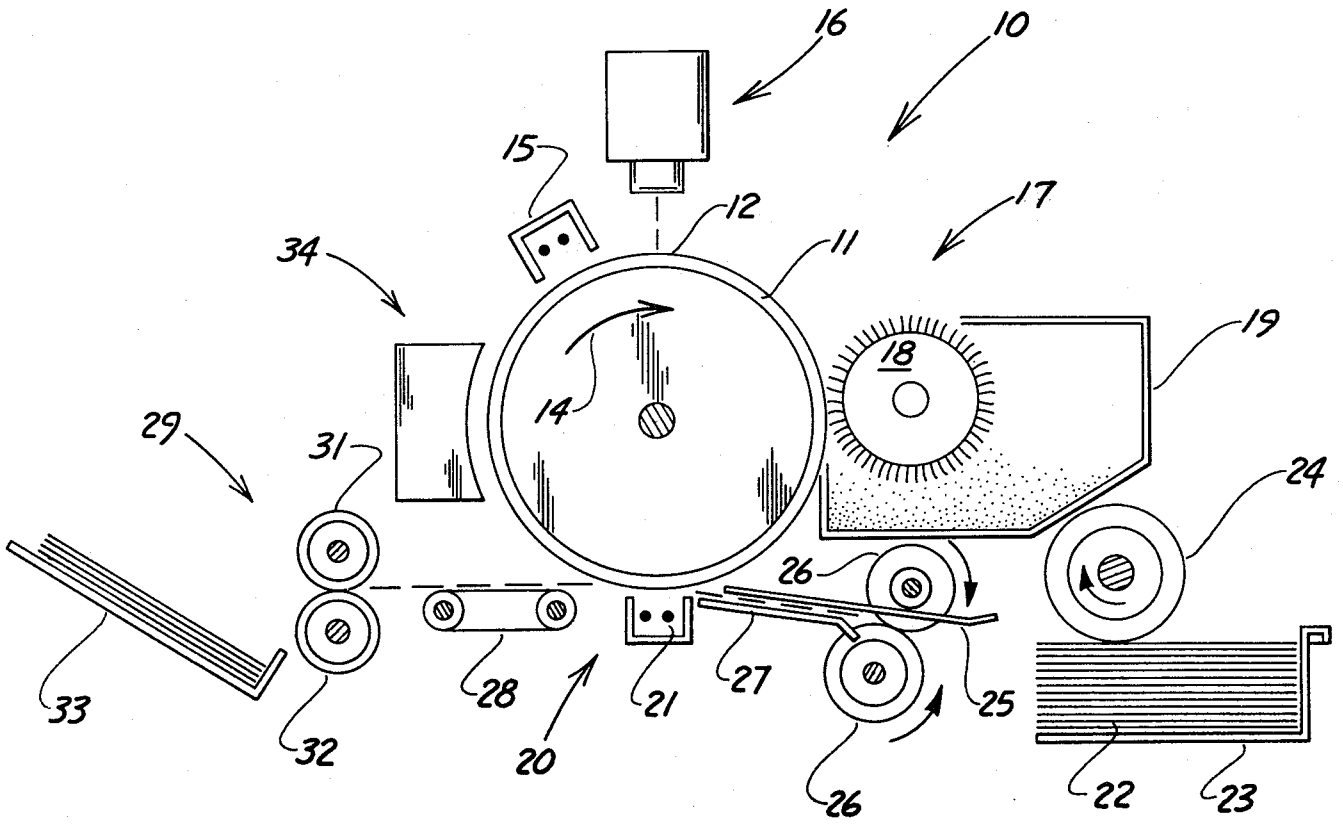
FIG. 1 is a schematic sectional view of a copier.

Referring now to the drawings and particularly to FIG. 1 thereof, there is shown an electrophotographic copying machine employing a fusing device in which a heated fuser roll in accordance with the present invention can be utilized. The various processing stations shown in FIG. 1 will be represented in part as blocks and the processing stations will only be briefly described. The particular copying machine illustrated in FIG. 1 is merely exemplary as far as the present invention is concerned for a complete understanding of an xerographic process and, in particular, how a fusing apparatus is employed in such a process. A fusing apparatus employing a heated fuser roll in accordance with the present invention may be utilized in a wide variety of devices including coated paper copiers and plain paper copiers, and is not necessarily limited to the particular type of copier system shown in FIG. 1.

In FIG. 1, the reference numeral 10 generally designates an electrophotographic copying machine which includes a rotating drum 11 having a photoconductive surface 12 secured around the outer surface of the drum. Any of the numerous inorganic or organic photoconductive materials can be employed, such as for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed face down for copying. Overlying the platen would be a movable cover connected to one side of the carriage. An operator can raise and lower the cover and thereby place on or remove documents from the platen. A series of lamps would be used to illuminate the original document. By incorporating an optical system comprising mirrors and lenses a light image of the original document to be copied is projected onto the charged portion of photoconductive surface 12. The movement of the carriage and therefore the scanning of the original document is in timed relationship with the movement of rotating drum 11. Thus photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles are usually a heat settable plastic. However, a single component toner can also be used. Preferebly a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of queuing rollers 26. At a predetermined time in the course of a copy cycle, the queuing rollers are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable apparatus, and advanced by, belt conveyor 28 to fixing station 29.

The copy sheet then passes into fixing station 29 which includes a fusing apparatus in which the toner material now residing on the copy paper is heated to a temperature at which the toner particles melt and are thereby fused into the copy paper so as to form a permanent copy of the original document. An example of a fusing apparatus including a heated fuser roll that forms the basic subject matter of the present invention is illustrated in its operative position in FIG. 1. As shown, the fuser apparatus includes a heated fuser member or roll 31, and a backup member or roll 32. The copy sheet with the toner powder image thereon is interposed between fuser roll 31 and backup roll 32. A release material, e.g. polytetra-fluoroethylene, can be on the fuser roll to prevent offset and allow for easy release of the paper from the roll. After the toner image is permanently affixed to the copy sheet, the sheet is separated from the fuser roll and advanced to a catch tray 33 for subsequent removal from the copier by an operator.

In order to remove residual toner particles which adhere to photoconductive surface 12 after the transfer of the powder image to the copy sheet, copying machine 10 is provided with a cleaning system generally designated by reference number 34. The cleaning mechanism can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Figure 2:
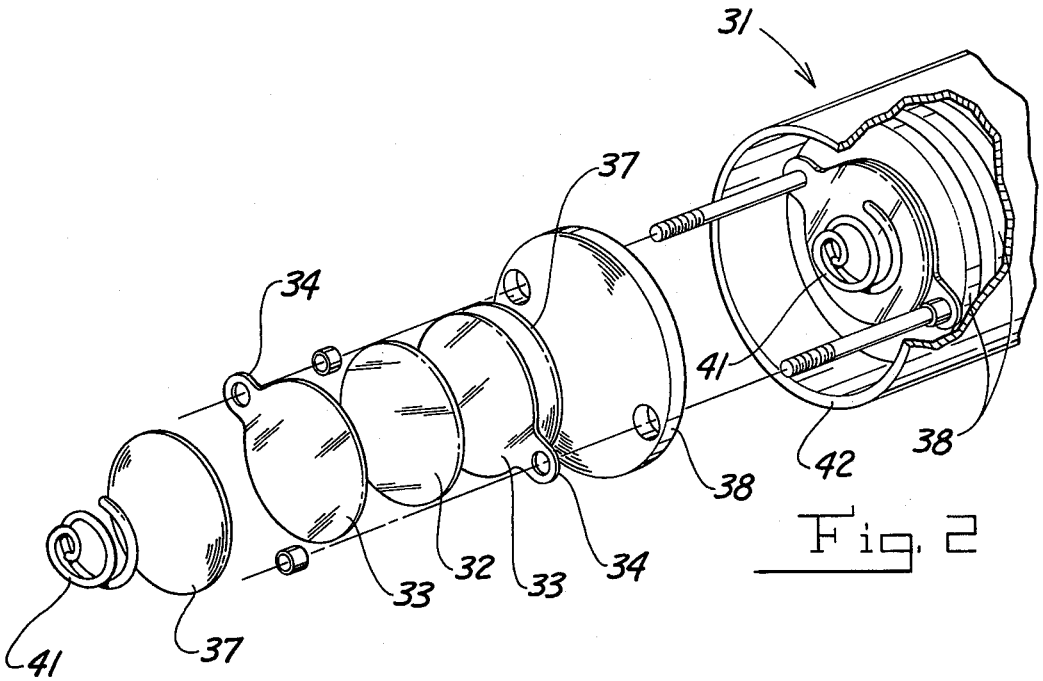
FIG. 2 is an exploded perspective view of a portion of a first preferred embodiment of a heated fuser roll in accordance with the present invention.
Figure 3:
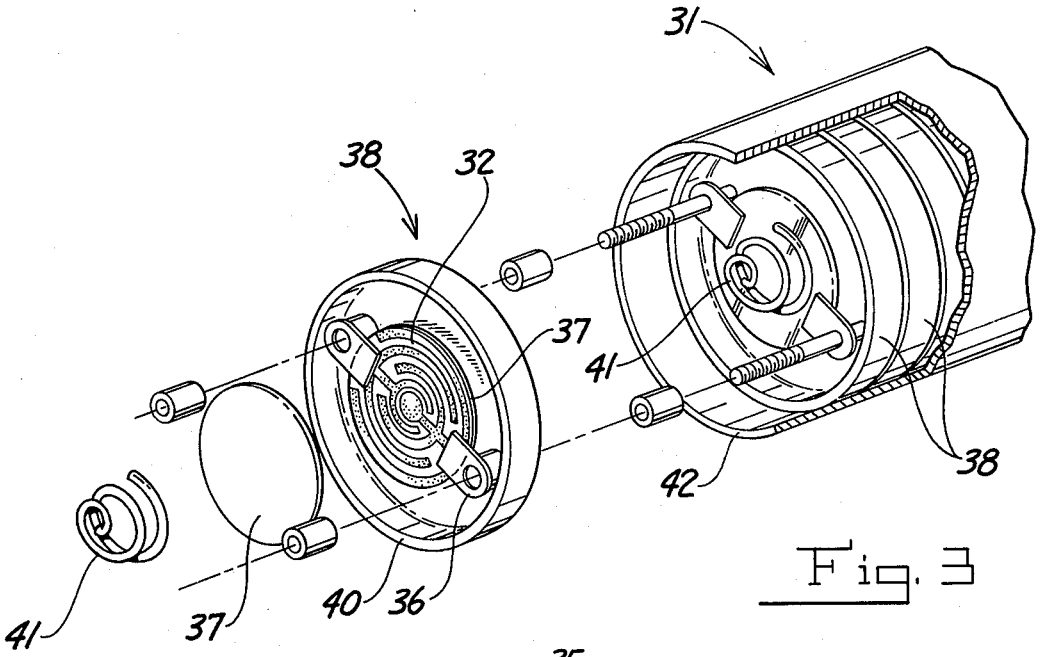
FIG. 3 is an exploded perspective view of a portion of a second preferred embodiment of a heated fuser roll in accordance with the present invention.

Referring now to the specific subject matter of the present invention, there is illustrated in FIGS. 2 & 3 a heated fuser roll 31 in accordance with the features of the present invention incorporating several preferred embodiments. The structure of fuser roll 31 is in the form of a circular cylinder and includes at least one heating unit each of which comprises a wafer shaped heating element 32 and an electrically conductive member for providing electrical current to heating element 32, which member lies in contiguous relation to the heating element. In accordance with the present invention a heated fuser roll 31 can include only one heating unit. However, it is preferred to employ a plurality of these units in a fuser roll to obtain the maximum heating benefits therefrom.

Heating elements 32 are formed of a semiconducting ceramic material which has a positive temperature coefficient of resistivity and exhibits a Curie temperature transition point at which the resistance of the material increases with increasing temperature. The preferred semiconducting ceramic materials embodied within the present invention have a Curie temperature or transition temperature such that when the material reaches its particular Curie temperature the resistance of these materials increases by several powers of ten. These materials, when employed as heating elements 32, impart to fuser roll 31 the ability to operate as a self-regulating heat source. At a given voltage heating elements 32 will draw a high current. This is because the elements are cold and their resistance is low. Within a few seconds the Curie temperature of the ceramic material is reached, there is a sharp increase in resistance, e.g. from 50 ohms to 5,000 ohms, and an immediate restriction in the amount of power absorbed. Thereafter a state of equilibrium arises in which the power absorbed adjusts itself such that it is equal to the heat dissipated. Thus, the material tends to keep its temperature substantially in the vicinity of the Curie temperature. The particular ceramic material compostion that is chosen for use as the heating element, of course, depends upon the fusing temperature requirements. In accordance with the present invention, ceramic semiconducting materials that exhibit Curie temperatures within the range of about 150° C. to about 220° C. are the preferred materials for use as heating elements 32. Compostions comprising barium titanate with strontium titanate and/or lead titanate, and a small amount of lanthanum in the form of lanthanum titanate, e.g. 0.3 mol%, (lanthanum is added in sufficient amount to impart semiconductive properties to the material) are particularly well suited as compositions for these heating elements. Details of these ceramic materials as heating elements for fusers can be found in commonly assigned and copending U.S. patent application entitled "Temperature-Self Regulating Fuser" by Donald T. Dolan (Ser. No. 041,024, filed May 21, 1979).

An example of the physical dimensions for one preferred wafer-type heating element 32 in accordance with the present invention would be a wafer having a diameter of about one inch and a thickness of about 0.125 inches.

When a heating unit is formed of the specific embodiment for a heating unit as shown in FIG. 2. i.e. a heating element 32 in conjunction with electrically conductive members in the form of disk shaped conductive plates 33, then it is preferred to coat both of the flat surfaces of heating elements 32 with a metal coating of a sufficient thickness to achieve intimate and uniform electrical contact between the heating elements and the surrounding conductive plates 33. A coating thickness ranging from about 0.001" to about 0.002" of a material such as silver or aluminum is preferred. These coatings can be placed on the heating elements by, for example, a vacuum deposition process or a suitable silk screening process. These metal coatings also help to provide uniform and rapid distribution of the heat throughout the length of fuser roll 31.

Figure 4:
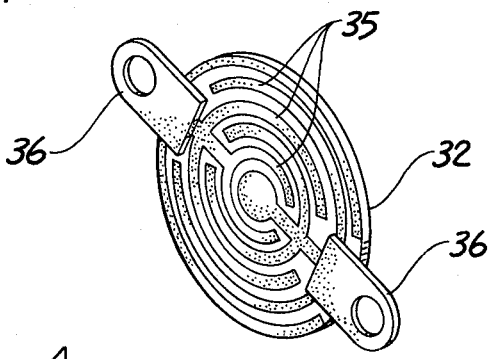
FIG. 4 is a perspective view of a preferred embodiment of a wafer-type heating element in accordance with the present invention.

Fuser roll 31 includes electrically conductive members that are the means by which the electric current flows from the electric source to each of heating elements 32. To best achieve this result, the electrically conductive members are positioned within the fuser roll so that they are in contiguous relation to the heating elements. In one preferred embodiment in accordance with the present invention as is shown in FIG. 2, electrically conductive members in the form of disk like plates 33 are positioned against both flat surfaces of wafer type heating elements 32. Plates 33 include a means for allowing the current to flow to and from the plates, preferably in the form of lugs 34 which extend from each of the conductive plates. In view of the required electrical and thermal properties of this structure, plates 34 are preferably made of a material having both excellent electrical and thermal conductivity properties such as, for example, copper or brass. Plates having a thickness of about 0.010" are eminently suited for this purpose. In another preferred embodiment in accordance with the present invention as is shown in FIGS. 3 and 4 heating elements 32 include electrically conductive members 35 that are coated on one surface of each of the heating elements, preferably in the form of a maze to evenly distribute the current throughout each of the heating elements. Secured to conductive members 35 are means for allowing the current to flow to and from the conductive members, preferably in the form of lugs 36. Conductive member 35 is preferably formed of a highly electrically conductive metal such as, for example, aluminum or silver, that is able to be coated onto one surface of a wafer shaped heating element in a maze-like configuration. Coating thicknesses of about 0.001 to about 0.005 inches are preferred.

To prevent a short circuit from occurring while operating fuser roll 31, an insulating material such as insulators 37 are preferably positioned between each of the electrically conductive members, i.e. conductive members 33 or 35, and thermally conductive plates 38. It is preferred to use a material which in addition to its insulating properties has sufficient thermal conductivity to allow the heat to be evenly distributed throughout the fuser roll. An example of an electrical insulating material having these properties is Kapton, an insulator manufactured by the DuPont Corporation. A material having a thickness of about 0.001 to 0.003 inches is preferred. In the embodiment illustrated in FIG. 2, the outer surfaces of conductive members 33 could be coated with an electrical insulator such as, for example, a high temperature polyurethane varnish.

Separating each of the heating units is a thermally conductive plate 38 which provides a means for allowing the heat to flow from heating elements 32 to the working surface of fuser roll 31. Plates 38 are therefore preferably made of a material having excellent thermal conductivity properties. Materials which are eminently suited for this purpose include, for example, metals such as aluminum, copper or brass. In one of the preferred embodiments of the present invention as shown in FIG. 3 disk-like conductive plates 38 include a lip 40 surrounding the plate and forming a cup-like closure means. As shown, each of these cup-like closure means can contain a heating unit.

Positioned between each of thermally conductive plates 38 and insulators 37 is a spring element 41. Spring elements 41 allow for sufficient space to exist between each of the heating units such that the fuser structure can withstand the repeated thermal cycles which occur during operation of the fuser, and at the same time help to position all of the internal parts in close contact with each other.

Sleeve member 42 preferably formed of a material having high thermal conductivity characteristics, such as for example, aluminum, brass or copper contains all of the internal parts of the fuser, and provides the basic work surface for heated fuser roll 31. Sleeve member 42 is provided with an outer layer of a material which will help prevent offsetting or sticking of the toner to the roll as the roll rotates in contact with the toner. For example, outer layer can be fabricated of a polytetrafluoroethylene material (e.g. Teflon) or a silicone elastomer coated with silicone oil as well as silicone elastomers containing low surface energy fillers such as fluorinated organic polymers, and the like.

While this invention has been described in conjunction with a specific embodiment thereof, it is evident that many alternatives, modifications and variations will be apparent to those skilled in the art. Accordingly, the present invention is intended to embrace all such alternatives, modifications and variations which fall within the spirit and scope of the appended claims.

I claim:

1. A heated fuser roll for use in a fusing apparatus for fixing toner images to a support surface, said fuser roll comprising:

at least one heating unit, each unit including (i) a wafer-shaped heating element formed of a semiconducting ceramic material having a positive temperature coefficient of resistivity and exhibiting a Curie temperature transition point at which the resistance of said material increases with increasing temperature and (ii) an electrically conductive member for providing electrical current to said heating element, said member being in contiguous relation to said heating element;

at least one thermally conductive plate, each heating unit being separated from each other by one of said plates;

an insulating member positioned between each of said electrically conductive members and said thermally conductive plates;

a spring element positioned between each of said thermally conductive plates and said insulating members; and a sleeve positioned around each of said heating units.

2. A roll according to claim 1 wherein said heating elements include a flat surface, and each of the flat surfaces of said heating elements are plated with a metal.

3. A roll according to claim 2 wherein said electrically conductive members are disk-shaped members lying in contiguous relation to the flat surfaces of said heating elements, said members including means for supplying electrical current to the members.

4. A roll according to claim 3 wherein said means for supplying electrical current to said members is a lug.

5. A roll according to claim 3 wherein said electrically conductive members are made of copper or brass.

6. A roll according to claim 2 wherein said metal plating is silver or aluminum.

7. A roll according to claim 1 wherein said electrically conductive members are in the form of a coating secured to a flat surface of each of said heating elements.

8. A roll according to claim 7 further comprising means for supplying electrical current to the members.

9. A roll according to claim 8 wherein said means for supplying electrical current to said members is a lug.

10. A roll according to claim 1 wherein said thermally conductive plates are made of aluminum, copper or brass.

11. A roll according to claim 1 wherein said thermally conductive plates are disks.

12. A roll according to claim 11 wherein said disks include a lip surrounding each disk and forming a closure means for containing said heating units.

13. A roll according to claim 1 wherein said ceramic material exhibits a Curie temperature ranging from about 150° C. to about 220° C.

14. A roll according to claim 13 wherein said ceramic material comprises barium titanate, strontium titanate and/or lead titanate, and lanthanum.

15. A roll according to claim 1 wherein said sleeve is made of aluminum, copper, or brass.

16. A roll according to claim 1 further comprising an outer layer of silicone rubber covering said sleeve.

17. A roll according to claim 1 further comprising an outer layer of polytetra-fluoroethylene covering said sleeve.

* * * * *

UNITED STATES PATENT AND TRADEMARK OFFICE

CERTIFICATE OF CORRECTION

PATENT NO. : 4,253,007

DATED : February 24, 1981

INVENTOR(S) : Hugh St. L. Dannatt

It is certified that error appears in the above—identified patent and that said Letters Patent is hereby corrected as shown below:

Column 2, line 4, change ":" to -- ; --.

Column 4, line 34, change "Preferebly" to -- Preferably --.

Signed and Sealed this

*Twelfth* Day of *January 1982*

[SEAL]

*Attest:*

GERALD J. MOSSINGHOFF

*Attesting Officer*

*Commissioner of Patents and Trademarks*